US007493899B2

(12) United States Patent
Davies

(10) Patent No.: US 7,493,899 B2
(45) Date of Patent: Feb. 24, 2009

(54) MICROPHONE ADAPTOR FOR A RESPIRATOR

(75) Inventor: John Davies, York (GB)

(73) Assignee: Selex Comunications Limited, Essex (GB)

( * ) Notice: Subject to any disclaimer, the term of this patent is extended or adjusted under 35 U.S.C. 154(b) by 854 days.

(21) Appl. No.: 10/626,187

(22) Filed: Jul. 24, 2003

(65) Prior Publication Data

US 2004/0194782 A1 Oct. 7, 2004

Related U.S. Application Data

(63) Continuation of application No. PCT/GB02/00173, filed on Jan. 16, 2002.

(30) Foreign Application Priority Data

Jan. 29, 2001 (GB) ..... 0102232.6

(51) Int. Cl.

| | |
|---|---|
| ***A62B 18/08*** | (2006.01) |
| ***A62B 9/04*** | (2006.01) |
| ***H04R 1/02*** | (2006.01) |
| ***H04R 9/08*** | (2006.01) |
| ***H04R 11/04*** | (2006.01) |
| ***H04R 17/02*** | (2006.01) |
| ***H04R 19/04*** | (2006.01) |
| ***H04R 21/02*** | (2006.01) |

(52) U.S. Cl. ..... 128/201.19; 128/202.27; 381/361; 381/367; 381/386; 381/390

(58) Field of Classification Search ..... 128/201.19, 128/201.25, 202.27, 205.25, 205.29, 206.12, 128/206.16, 206.17; 381/95, 122, 361, 367, 381/386, 390

See application file for complete search history.

(56) References Cited

U.S. PATENT DOCUMENTS

| | | | | |
|---|---|---|---|---|
| 3,180,333 | A * | 4/1965 | Lewis | 128/201.19 |
| 3,184,556 | A * | 5/1965 | Larkin | 379/430 |
| 4,118,606 | A * | 10/1978 | Larkin | 379/430 |
| 4,491,699 | A * | 1/1985 | Walker | 379/174 |
| 4,537,276 | A * | 8/1985 | Confer | 181/21 |
| 4,903,298 | A * | 2/1990 | Cline | 380/270 |

(Continued)

FOREIGN PATENT DOCUMENTS

| | | |
|---|---|---|
| CH | 163 143 | 7/1933 |

(Continued)

OTHER PUBLICATIONS

"New Eagle Communications" product catalog, Silver Lake, KS, USA, 1993.

(Continued)

*Primary Examiner*—Justine R Yu
*Assistant Examiner*—Kristen C Matter
(74) *Attorney, Agent, or Firm*—Martin Fleit; Paul D. Bianco; Fleit Gibbons Gutman Bongini & Bianco PL

(57) ABSTRACT

A microphone adaptor for a respirator is provided which has a sound tube that extends between a speech projector of the respirator and a microphone enabling clear speech to be received by the microphone. The adaptor may include a microphone box for receiving the microphone, preferably a headset boom microphone of a standard issue headset.

19 Claims, 2 Drawing Sheets

U.S. PATENT DOCUMENTS

| | | | | | |
|---|---|---|---|---|---|
| 4,980,926 | A | * | 12/1990 | Noetzel | 398/117 |
| 5,103,815 | A | * | 4/1992 | Siegel et al. | 128/205.23 |
| 5,224,474 | A | * | 7/1993 | Bloomfield | 128/201.19 |
| 5,279,286 | A | * | 1/1994 | Chen | 128/201.19 |
| 5,428,688 | A | * | 6/1995 | Becker et al. | 381/344 |
| 5,463,693 | A | * | 10/1995 | Birli et al. | 381/75 |
| 5,572,990 | A | * | 11/1996 | Berlin | 128/201.19 |
| 5,860,417 | A | | 1/1999 | Kettl et al. | |
| 5,895,537 | A | * | 4/1999 | Campbell | 156/73.1 |
| 5,933,511 | A | * | 8/1999 | Garth, Sr. | 381/367 |
| 5,990,793 | A | * | 11/1999 | Bieback | 340/573.1 |
| 6,167,251 | A | * | 12/2000 | Segal et al. | 455/406 |

FOREIGN PATENT DOCUMENTS

| | | | |
|---|---|---|---|
| DE | 33 42 063 | | 5/1985 |
| EP | 0 686 408 | | 12/1995 |
| GB | 2 165 721 | | 4/1986 |
| WO | WO 97/37724 | * | 10/1997 |

OTHER PUBLICATIONS

"New Eagle Communications" design drawing, Gas Mask Adapter, Scott AV2000, New Stawn, KS, USA 1999.

"New Eagle Communications" design drawings, Gas Mask Adapter Assembly (Avon, M17, M40, Scott 65), Adapter MIc (NCW, NNC, NC), 1995.

* cited by examiner

MICROPHONE ADAPTOR FOR A RESPIRATOR

RELATED APPLICATION

This application is a continuation of International Application PCT/GB02/00173, filed Jan. 16, 2002, the contents of which are herein incorporated by reference in their entirety.

BACKGROUND OF THE INVENTION

1. Field of the Invention

The present invention relates to a microphone adaptor for a respirator and particularly, but not exclusively, to such an adaptor for use with a nuclear, biological and chemical (NBC) respirator of the type worn by service personnel 2. Prior Art Defence organisations throughout the World have for many years supplied soldiers and other service personnel with respirators to protect them from NBC exposure. Respirators are normally in the form of a full face mask protecting the complete face of the service personnel wearing them including the eyes. The respirator seals tightly against the face to ensure that air breathed is drawn in through an appropriate filter and exhaled through a one way non-return valve (exhale valve).

Respirators are normal made out of a rubber type material so that they are flexible enough to permit a standard issue respirator to fit and seal against the many varied face shapes that may find themselves wearing such a respirator. Unfortunately, the materials respirators are normally manufactured from are not particularly efficient at transmitting acoustic sound waves and thus there is a problem permitting service personnel to communicate, with each other either directly or via radio, when they are wearing NBC respirators.

Originally, the problem with radio communications was addressed by having a microphone mounted to the front of a respirator through which an operative could communicate with a radio. However, this did not solve the problem of enabling the operative to communicate with his immediate colleagues by direct speech. To solve this problem some respirators now incorporate a speech projector mounted in front of the respirator in front of the operatives mouth. One such respirator is the S10 used by the British Army, seen in FIGS. 1 and 2 on the accompanying drawings (FIG. 2 being a cross section along the line 1-1 of FIG. 1). The speech projector enables the operative to talk, or shout, directly to his colleagues, but this has necessitated relocation of the microphone for his radio and a speech diaphragm has been incorporated at the side of the mask to which a standard issue microphone may be fitted, either by clipping or screwing over the speech diaphragm. The speech diaphragm is adapted to be "sound transparent" relative to the other material of the respirator whilst ensuring a complete seal to ensure protection of the operative whether or not the microphone is fitted, or fitted incorrectly.

Respirators typically comprise an inner face seal, which is between the mouth of the operative and the speech diaphragm. This inner face seal degrades speech reaching the speech diaphragm and indeed the speech diaphragm itself is not perfectly transparent to speech. Thus, speech received by a microphone mounted to the speech diaphragm is of relatively poor quality compared to speech that would be received directly from the operative.

In addition to the above problem, of transmission of speech through the inner seal and the speech diaphragm, the performance of a respirator microphone in high background noise is also poor because the coupling to the microphone has to be open to the air otherwise a pressure wave between the microphone and the respirator further distorts speech.

SUMMARY OF THE INVENTION

The present inventor has realised that although the present arrangement is used by many of the world's military forces the above problems will be particularly problematic when the next generation of digitally encrypted radios are employed for the following reason.

The future use of military radios will involve the addition of digitally encrypted speech to increase the security of radio messages. Digitally encryption involves the conversion of analogue speech to a digital signal before encryption in the transmitting radio. The characteristics of digital conversion often result in the lower frequencies of the audio band having a disproportionate influence on the encryption due to the greater values placed by the system on lower frequencies.

Research by the inventor on radios of this type has shown that normal speech emanating from conventional respirator microphones deteriorates to a greater extent when transmitted over an encrypted radio link than when used over a clear radio link. The use of microphones with better response at higher frequencies improves the performance, so it can be deduced from this observation that the resonant effect of the respirator and the increased low frequency response of a conventional microphone working through a speech diaphragm of a respirator is a contributing factor to the degradation.

The present invention aims to provide a solution to the above problem identified by the present inventor.

According to a first aspect of the present invention there is provided a microphone adaptor for a respirator having a speech projector, the adaptor comprising a sound tube with a first open end arranged to be located in the vicinity of the speech projector of the respirator and a second open end arranged to be attached to a microphone, whereby speech emanating from the speech projector can be transmitted via the sound tube of the adaptor to the microphone.

The present invention enables speech to be received from the speech projector of a modern respirator without the need to mount a microphone in the proximity of the speech projector, which may impede the speech from the speech projector. More importantly, by employing the present invention speech is received from the speech projector which speech has a direct path from the mouth of the operator through the open exhale diaphragm (one has to exhale to speak) through the sound projector to the microphone via the microphone adaptor. The advantage of this is that because the speech is direct, and has not passed through the fabric of the respirator, the high frequency components are substantially intact making the invention particularly advantageous if the microphone is connected to a digitally encrypted radio.

Preferably the adaptor comprises a microphone box in which the second open end of the sound tube terminates, said box being arranged to fit over a microphone and shield the microphone from any incident sound other than that received via the sound tube. This enables the adaptor to be fitted over an already existing microphone which may be associated with the operative and preferably the microphone box is arranged to reasonably push over a microphone enabling the adaptor to be easily fitted over the microphone only when the respirator is being worn. Thus, the microphone box can be removed and the microphone used normally when the respirator is not being worn.

The present invention provides significant advantages over current arrangements, where a standard issue microphone is clipped to the speech diaphragm on the side of the respirator.

In addition to the improvement in speech quality there is also no requirement for an additional respirator microphone. This is particularly advantageous for this would require an additional connector for that microphone. This, for example, may avoid the need to employ an additional connector on the operatives headset, comprising earphones and a boom microphone, which connector, if to military standard, would be bulky and a potential hazard relative to the typically otherwise lightweight and "soft" components of the headset. Also a specially wired and switched headset will not be required, which would otherwise be necessary to allow muting of the standard microphone when the external respirator microphone is connected.

It is particularly advantageous if the microphone box is arranged to push over a boom microphone of a headset, for in the event of an NBC incident the operative can simply put the respirator on, put his headset back on and slip the boom microphone into the microphone box of the adaptor.

In addition to the "convenience" and improved performance provided by the present invention there is also a significant cost saving. The costs of an adaptor in accordance with the present invention are of the order of one tenth of costs associated with the current microphone arrangement.

The adaptor of the invention may comprise a sound tube locator attached to the first open end of the sound tube and arranged to locate the sound tube in the speech projector of a respirator. The adaptor may be arranged to be a push fit and may either releasably attach to the speech projector or permanently attach the adaptor in position.

As the adaptor of the present invention can be lightweight, robust and relatively cheap, and because it does not interfere to any significant extent with the speech projected by the speech projector, it may be advantageous to leave the adaptor permanently in position on the speech projector to ensure that it is not misplaced.

In accordance with a second aspect of the invention there is a provided a respirator having a speech projector and a microphone adaptor as described above. In accordance with this aspect of the invention, the sound tube may be formed as part of the respirator and the tube may be integrally moulded within the material of the respirator.

The respirator preferably comprises an exhale diaphragm located in a region substantially in front of the mouth of an operative which diaphragm opens into the speech projector to provide a direct passage between the mouth of the operative and the first open end of the sound tube when the operative exhales during the speech process. This provides a clear passage for speech direct to the microphone.

In accordance with a third, aspect of the invention there is provided Battlefield communication equipment comprising:

a. a headset to be worn by an operative, the headset having earphones, a boom microphone and a connection for a radio enabling the operative to have two way communication;

b. a respirator; and c. a microphone adaptor, the microphone adaptor having a sound tube and a microphone box arranged such that when the operative is wearing the respirator the operative can put the sound box over the boom microphone of the headset, the adaptor being arranged to receive speech from within the respirator and transmit that speech via the sound tube and microphone box to the boom microphone.

BRIEF DESCRIPTION OF THE DRAWINGS

One embodiment of the present invention will now be described by way of example only with reference to the accompanying figures of which.

DETAILED DESCRIPTION OF PREFERRED EMBODIMENTS OF THE INVENTION

Figure 1:
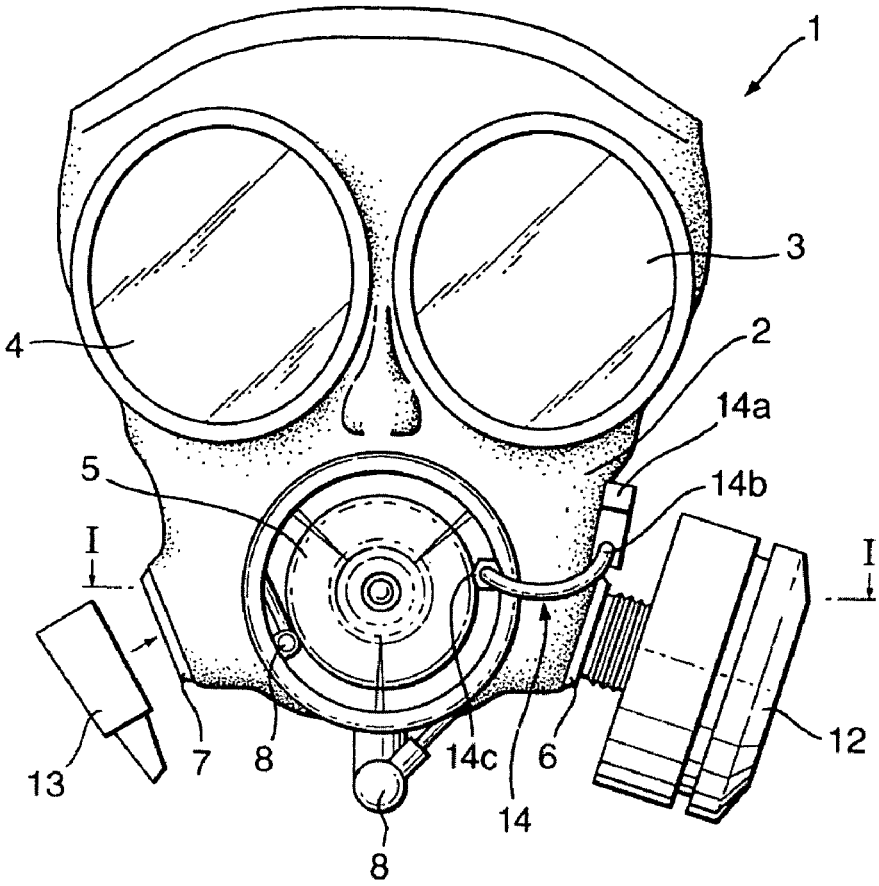
FIG. 1 illustrates a respirator and microphone adaptor in accordance with the present invention.
Figure 2:
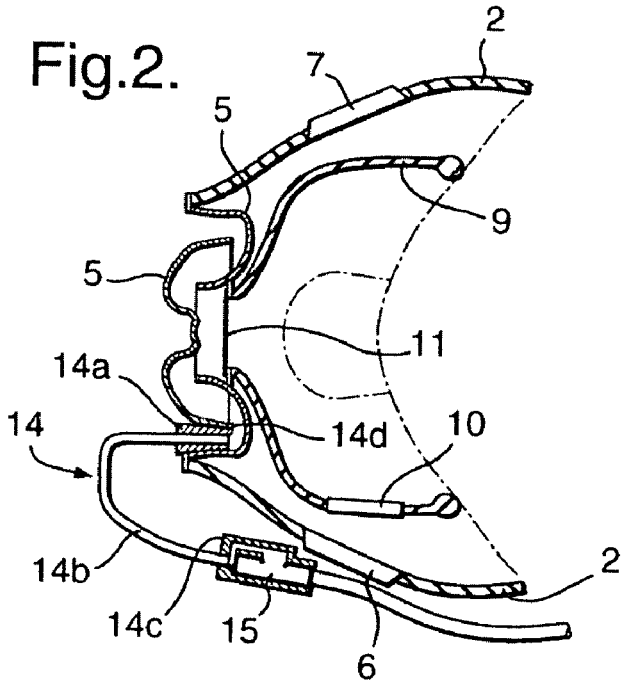
FIG. 2 is a cross section through the line 1-1 of FIG. 1.

Referring now to FIGS. 1 and 2, a respirator, indicated generally as 1, comprises a rubber mask body 2 having two windows 3 and 4, a speech projector 5, an inlet filter 6, a speech diaphragm 7, a drinking tube 8 and, (shown in FIG. 2 only) an inner face seal 9 for sealing to the face of an operative (indicated by the broken line) the face seal 9 having an inlet diaphragm 10 and an exhale diaphragm 11 therein.

The components so far referred to are standard on some respirators and the respirator illustrated is an S10 used by the British Army. In FIG. 1 two additional components have been shown for illustrative purposes only and that is the filter canister 12, attached to a filter canister fitting formed as part of the inlet filter 6, (through which air is drawn in) and a standard issue service microphone 13, which clips to the speech diaphragm 7, but is shown for illustrative purposes only as this is redundant when the present invention is employed.

Also shown fitted to the respirator of FIGS. 1 and 2 is a microphone adaptor in accordance with the present invention indicated generally as 14. This comprises a sound tube locator 14*a*, sound tube 14*b* and microphone box 14*c* clipped over a boom microphone 15 of a headset.

Figure 3:
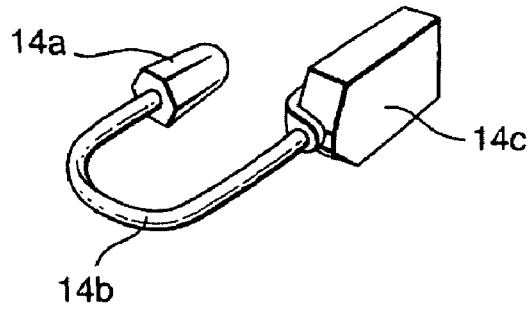
FIG. 3 is a perspective view of the components of the microphone adaptor of FIGS. 1 and 2.

As shown more clearly in FIG. 3 the adaptor comprises sound tube locator 14*a* which may be made of rubber or similar elastic material attached to a first open end of a sound tube 14*b*, which may be formed of polyurethane or some other material which is preferably semi rigid such that it retains the shape illustrated. To the second open end of the sound tube 14*b* is attached to microphone box 14*c*.

Figure 4A:
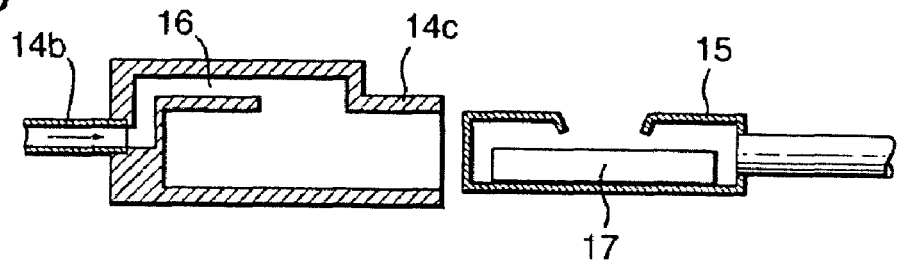
FIG. 4A illustrates the microphone box of the microphone adaptor of FIG. 3 prior to connection to a boom microphone.
Figure 4B:
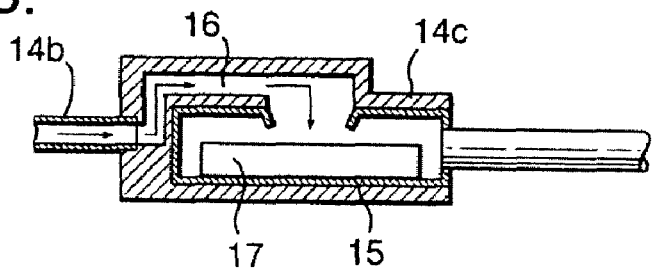
FIG. 4*b* illustrates the microphone box of FIG. 4 attached to the boom microphone.

Referring to FIG. 4A, a microphone box 14*c* is shown remote from headset boom microphone 15, and in FIG. 4B shown mounted over the boom microphone. From FIGS. 4A and 4B it is seen that the microphone box 14*c* comprises a sound tube 16, which extends the sound tube 14*b* to the microphone transducer 17.

Figure 5:
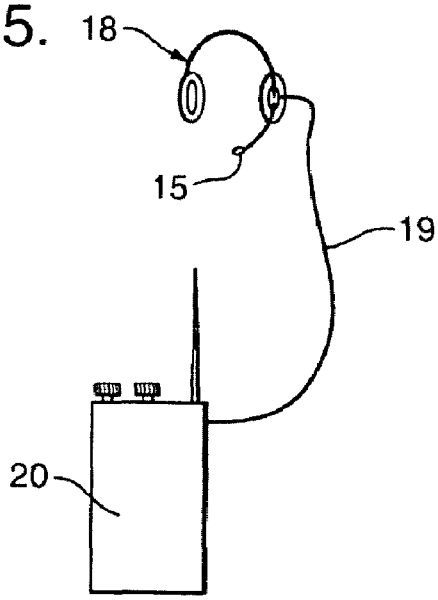
FIG. 5 schematically illustrates the connections of a boom microphone to a headset and radio.

Referring to FIG. 5, for completeness, there is shown a boom microphone 15, attached to standard headset 18, which in turn is attached by lead 19 to a digitally encrypted radio 20.

In operation the respirator functions by air being filtered by the canister 12 of FIG. 1 as it is drawn through inlet diaphragm 10 in inner face seal 9 by the action of an operative breathing in. The purpose of the inner face seal 9 is to ensure that only fresh air coming into the mask can reach windows 3 and 4 by confining exhaled air within the region below windows 3 and 4 defined by the inner face seal 9. Air that is breathed out by an operative passes through exhale diaphragm 11 through speech projector 5 to atmosphere without coming into contact with the windows, thus reducing any problems with condensation.

The speech projector 5 comprises a plastic nose cone with curves shaped inside the nose cone resembling a loudspeaker re-entrant horn. Speech projector 5 enables an operative to speak directly to his colleagues for in the process of speaking he will exhale opening exhale diaphragm 11, thus providing a direct speech path to the outside via speech projector 5.

The sound tube locator 14 is simply pushed in to the plastic nose cone of the speech projector 5 where it is retained in place by means of lip 14*d* engaging behind the nose cone, as shown in FIG. 2. The sound tube locator 14*a* has a cross section which, as seen in FIG. 1, orientates it such that the microphone box is positioned along the outside of the respirator, in the approximate location of a boom microphone attached to the headset 18 of an operative.

The microphone adaptor 14, when attached to the microphone 15, forms a path which when an operative speaks and exhales, thereby opening exhale diaphragm 11, provides a direct and unimpeded sound patch from the mouth of the operative through the exhale diaphragm 11 and speech projector 5 to the microphone 15, via the sound tube 14*b* and microphone box 14*c*. This direct path enables speech to be received by the microphone with relatively little degradation of the high frequency components.

The adaptor 14 may be configured such that it is permanently retained in the speech projector or it may be configured such that it may be removable. Whichever, when an NBC incident occurs the operative removes his headset, puts the respirator over his head in the normal manner and then, replacing his headset, pushes the microphone box 14*c*, of the adaptor 14, over the headset boom microphone 15. The operative is then able to communicate efficiently via his digitally encrypted radio 20, shown in FIG. 5, by means of the normal headset 18 without any additional microphone, wires or connections associated therewith having to be employed.

The above describes a preferred embodiment and is given by way of example only. It will readily be appreciated that the invention, as defined by the scope of the appended claims, may be employed in any number of configurations. Particularly the microphone adaptor illustrated has been designed for use with existing standard issue respirators. However, it is realised that if a new respirator is to be designed it would be possible to build a microphone adaptor into the respirator and in such a scenario the sound tube could comprise a passage within the material of the respirator itself. This passage would extend between the speech projector and the microphone box which could likewise comprise a recess in the material of the respirator in which recess the sound tube would terminate and which recess is adapted for receiving the headset boom microphone. Additionally, in the embodiment illustrated advantage has been taken of the speech projector already incorporated in many existing respirators. However the sound tube, whether an "add-on" or integrally formed within the respirator, could extend directly to the point at which there is a direct clear path to the operatives mouth. However it would be preferable that the sound tube extend only to the down stream side of the exhale diaphragm such that the sound tube could not compromise the integrity of the respirator by allowing contaminated air to reach the inside of the inner face seal.

The invention claimed is:

1. A microphone adapter for a respirator having an exhale diaphragm, the adapter comprising a sound tube with a first open end designed to be located and held proximate the exhale diaphragm, to receive and conduct speech sound travelling in exhaled air therefrom, and a second open end designed to be coupled to transmit the sound to a microphone located outside and adjacent the respirator; and a microphone receptor that receives the second open end of the sound tube and is adapted to be releasably pushed over the microphone; whereby, in use, speech emanating from the exhale diaphragm is conducted by and transmitted via the sound tube to the microphone.

2. An adapter according to claim 1 wherein the second open end of the sound tube terminates in the microphone receptor, said receptor being arranged to fit over a microphone located outside and adjacent the respirator and shield the microphone from incident sound other than that received via the sound tube.

3. A microphone adapter according to claim 1 wherein a resilient sound tube locator is mounted on the first open end of the sound tube.

4. A microphone adapter according to claim 3 wherein the sound tube locator is shaped so that when a boom microphone is located outside and adjacent the respirator, the second end of the sound tube lies proximate the boom microphone.

5. A microphone adapter according to claim 1 wherein the sound tube is U-shaped and composed of semi-rigid material.

6. The microphone adapter of claim 1, further comprising a speech projector disposed proximate the exhale diaphragm, the speech projector adapted to project speech sound that has passed in exhaled air through the exhale diaphragm, wherein the first open end is further located and held proximate the speech projector.

7. Battlefield communication equipment comprising:

(a) a headset to be worn by an operative, the headset having earphones, a boom microphone that lies adjacent the mouth of the operative and a connection for a radio enabling the operative to have two way communication;

(b) a respirator; and (c) a microphone adaptor, the microphone adaptor having a sound tube having a first open end and a second open end, a microphone box mounted on the second open end arranged such that when the operative is wearing the respirator, the operative can fit the first open end of the sound tube to the respirator and can fit the microphone box at the other end of the microphone adaptor over the boom microphone of the headset, the adaptor being arranged to receive speech from within the respirator and transmit that speech via the sound tube and microphone box to the boom microphone.

8. Battlefield communication equipment according to claim 7 wherein the respirator includes a speech projector and the microphone adaptor is arranged to receive speech from within the respirator via said speech projector.

9. Battlefield communication equipment according to claim 7 wherein the respirator includes a speech projector and an exhale diaphragm and the microphone adaptor includes the sound tube with a first open end being designed to be located and held relative to the speech projector to receive speech therefrom at a point downstream of the exhale diaphragm.

10. Battlefield communication equipment of claim 7 wherein the microphone box on the second open end of the sound tube fits over and shields the boom microphone from incident sound other than that received via the sound tube.

11. Battlefield communication equipment according to claim 7 wherein the microphone box is adapted to be releasably pushed over the boom microphone.

12. Battlefield communication equipment according to claim 7 wherein the radio to which the boom microphone is connected is a digitally encrypted radio.

13. A microphone adapter for a respirator having a speech projector comprising, a sound tube with a first open end designed to be mounted in the vicinity of the speech projector, and a second open end designed to be coupled with a boom microphone of a headset; and a microphone receptor in which the second open end of the sound tube terminates, said microphone receptor being designed and arranged to fit over and push releasably over the boom microphone to shield the boom microphone from incident sound other than that received via the sound tube; whereby, in use, speech emanating from the speech projector is transmitted via the sound tube to the microphone.

14. A combination of a respirator having a speech projector and a microphone adaptor as claimed in claim 13.

15. A combination according to claim 14 wherein the second open end of the sound tube terminates in said microphone receptor, said microphone being arranged to fit over a microphone and shield the microphone from incident sound other than that received via the sound tube.

16. A combination according to claim 14 wherein the respirator includes an exhale diaphragm that is located in a region substantially in front of the mouth of a wearer of the respirator, which diaphragm opens into the sound projector to leave a clear passage between the mouth of the wearer and the first open end of the sound tube when the wearer exhales during the speech process.

17. A combination according to claim 14 wherein the respirator includes an inner face seal which prevents exhaled air from reaching windows formed in an outer layer of the respirator wherein an exhale diaphragm provides a route for exhaled air from the inner face seal and into the speech projector.

18. A microphone adapter for a respirator having a speech projector and an exhale diaphragm, the adaptor comprising:

a sound tube with a first open end designed to be located and held relative to the speech projector to receive speech therefrom at a point downstream of an exhale diaphragm, and a second open end designed to be coupled with a boom microphone located outside and adjacent the respirator; and a microphone box in which the second open end of the sound tube terminates and is coupled with the interior of the microphone box, said box having an opening in one wall to enable the boom microphone to be slid into the microphone box to shield the microphone from incident sound other than that received via the sound tube and a wall structure that channels sound from the second end of the sound tube to the boom microphone;

whereby, in use, speech emanating from the speech projector is transmitted via the sound tube to the microphone.

19. A microphone adapter according to claim 18, wherein the sound tube is substantially U-shaped and composed of semi-rigid material, and a resilient sound tube locator is mounted on the first open end of the sound tube, and the sound tube is further shaped so that when a boom microphone is located outside and adjacent the respirator, the microphone box lies proximate the boom microphone.

* * * * *